US008794732B2

(12) United States Patent
Tsuchiya

(10) Patent No.: US 8,794,732 B2
(45) Date of Patent: Aug. 5, 2014

(54) MEDIA PROCESSING DEVICE, METHOD OF CONTROLLING A MEDIA PROCESSING DEVICE, AND A STORAGE MEDIUM

(71) Applicant: Seiko Epson Corporation, Tokyo (JP)

(72) Inventor: Akihiko Tsuchiya, NaganoTokyo (JP)

(73) Assignee: Seiko Epson Corporation, Tokyo (JP)

( * ) Notice: Subject to any disclaimer, the term of this patent is extended or adjusted under 35 U.S.C. 154(b) by 118 days.

(21) Appl. No.: 13/630,365

(22) Filed: Sep. 28, 2012

(65) Prior Publication Data

US 2013/0342600 A1 Dec. 26, 2013

(30) Foreign Application Priority Data

Sep. 29, 2011 (JP) ..... 2011-214100

(51) Int. Cl.
*B41J 29/38* (2006.01)
*B41J 2/01* (2006.01)

(52) U.S. Cl.
USPC ..... 347/16; 347/101; 347/104

(58) Field of Classification Search
CPC .. B41J 13/0027; B41J 11/0065; B41J 11/003; B41J 11/0095; B65H 2701/1313; B65H 2701/1311; B65H 2801/06
USPC ..... 347/16, 101, 104
See application file for complete search history.

(56) References Cited

U.S. PATENT DOCUMENTS

| | | | | |
|---|---|---|---|---|
| 8,339,681 | B2 * | 12/2012 | Nishimura et al. | 358/474 |
| 2002/0000692 | A1 * | 1/2002 | Yamada et al. | 271/279 |
| 2012/0049434 | A1 * | 3/2012 | Nonaka | 271/3.16 |

FOREIGN PATENT DOCUMENTS

| | | | |
|---|---|---|---|
| JP | 2002255393 | A | 9/2002 |
| JP | 2008102661 | A | 5/2008 |

* cited by examiner

*Primary Examiner* — Jannelle M Lebron
(74) *Attorney, Agent, or Firm* — Lowe Hauptman & Ham, LLP

(57) ABSTRACT

Media that are processed to reliably prevent executing a recording operation when media is not set to the recording position can be segregated from other media, and a drop in media processing throughput can be suppressed. When the length in the conveyance direction of the image to be recorded on a check is greater than the length of the recording area determined from the length of the check 4 in the conveyance direction, the process control unit 70*a* of a multifunction device 1 changes the discharge unit to which the check is discharged and then conveys the next check stored in the storage unit.

11 Claims, 7 Drawing Sheets

MEDIA PROCESSING DEVICE, METHOD OF CONTROLLING A MEDIA PROCESSING DEVICE, AND A STORAGE MEDIUM

Priority is claimed under 35 U.S.C. § 119 to Japanese Application nos. 2011-214100 filed on Sep. 29, 2011 which is hereby incorporated by reference in their entirety.

BACKGROUND

1. Technical Field

The present invention relates to a media processing device that conveys media and records on the media during conveyance, a method of controlling the media processing device, and a storage medium storing a program for achieving the method of controlling the media processing device.

2. Related Art

Media processing devices that convey media such as checks, and record images on the media while the media is being conveyed, are known from the literature. See, for example, Japanese Unexamined Patent Appl. Pub. JP-A-2002-255393. Some media processing devices of this type store plural sheets of media in a storage compartment, and process plural sheets of media continuously, including conveying and recording on the media.

Performing the recording operation when media is not at the recording position can cause trouble in devices such as these media processing devices that record while conveying the medium through the conveyance path. For example, ejecting ink from the inkjet head when media is not at the ink ejection position in recording devices that record images by ejecting ink with an inkjet head can soil the media and the recording device with ink. In recording devices that record images with a thermal printhead, performing the image recording operation when media is not at the recording position can adversely affect the life of the heating elements. Reliably preventing the recording operation from executing when recording media is not set to the recording position is therefore necessary in such devices.

When the image to be recorded on a particular single medium will not fit in the recording area of that single medium, and the recording operation will be executed when that medium is not at the recording position if something is not done, a special process could be applied to that medium to prevent the recording operation from executing. When plural media are conveyed in order to process the plural media continuously, and this special process is applied to one of the plural media, being able to clearly segregate the specially processed medium so that the single medium can later be separated from the other plural media is necessary. In addition, if continuous processing is interrupted so that the plural media can be processed continuously as in the media processing device described above, the time required to process all of the media can increase, possibly resulting in a significant drop in throughput. Suppressing such a drop in throughput as much as possible is therefore necessary.

SUMMARY

With consideration for the foregoing problem, the present invention reliably prevents the recording operation from executing when recording media is not at the recording position, segregates media to which the specific process that prevents the recording operation from executing is applied from other media while enabling continuous processing and suppressing a drop in process throughput.

One aspect of the invention is a media processing device that that can connect to a control device and includes: a storage unit that can hold a plurality of media; a conveyance path that connects to the storage unit and conveys the media; a plurality of discharge units that can connect to the conveyance path and receive media discharged from the conveyance path; a switching unit that changes the discharge unit into which the media are discharged; a conveyance unit that conveys the media from the storage unit through the conveyance path to the discharge unit; a recording unit that is disposed to the conveyance path and records on the media conveyed by the conveyance unit; and a process control unit that controls the switching unit, conveyance unit, and recording unit. When the length in the conveyance direction of an image to be recorded on the medium is greater than the length of a recording area determined by the length of the medium in the conveyance direction, the process control unit records the part of the image that will fit in the recording area with the recording unit, causes the switching unit to change the discharge unit so that media are discharged into different discharge units depending on whether the length of the recording area is shorter or longer than the image length, and then conveys the next medium stored in the storage unit with the conveyance unit.

Because only the part of the image that will fit in the recording area is recorded on the medium being processed when the length in the conveyance direction of the image to be recorded is greater than the length of the recording area, this aspect of the invention can reliably prevent the recording operation from executing when the recording medium is not set to the recording position. In addition, because media recorded with the part of the image that will fit in the recording area are discharged into a different discharge unit than the other media, such media can be obviously separated from the other media. In addition, because the length in the conveyance direction of the image recorded to one medium being greater than the length of the recording area on that medium is not treated as an error that causes processing to stop, and the next medium in the storage unit is conveyed and media processing continues in such cases, a drop in throughput can be effectively suppressed.

Furthermore, when the length in the conveyance direction of the image to be recorded on the medium being processed is greater than the length of the recording area of the medium, the part of the image that will fit in the recording area is recorded and executing the recording operation when the medium is not at the recording position is prevented instead of not recording any part of the image on the medium. Because there are situations in which not recording part of the image is allowable depending upon the properties of the image recorded on the medium, this aspect of the invention can appropriately handle such cases.

A media processing device according to another aspect of the invention also has a sensor that is disposed on the upstream side of the recording unit and detects the medium; and the process control unit detects the trailing end of the medium with the sensor, and uses the recording unit to record the part of the image that will fit in the recording area, by prohibiting the recording unit from recording an image on the upstream side of a position corresponding to the trailing end of the medium when the length of the image is greater than the length of the recording area.

By managing the position of the trailing end after the sensor detects the trailing end of the medium, and prohibiting image recording on the upstream side of a position corresponding to this trailing end, this aspect of the invention can use a simple means to reliably prevent image recording past the upstream side of the trailing end of the medium.

A media processing device according to another aspect of the invention also has a detection unit that detects the length of the medium conveyed by the conveyance unit. The process control unit calculates the length in the conveyance direction of the image to be recorded on the medium based on image data received from the control device, compares the calculated image length and the length of the recording area determined from the length in the conveyance direction of the medium detected by the detection unit, and when the length of the image is greater, records the part of the image that will fit in the recording area with the recording unit.

As a result, the image can be appropriately recorded based on the actual length of the medium conveyed through the conveyance path after determining whether the length of the medium or the length of the image to be recorded on the medium is longer.

When the length of the image is greater than the length of the recording area and the part of the image that will fit in the recording area is recorded, and the next medium stored in the storage unit can be processed, the process control unit in a media processing device according to another aspect of the invention reports the same to the control device.

When the length of the image to be recorded on the medium is greater than the length of the recording area on the medium, and the part of the image that will fit in the recording area is recorded, the control device side can execute an appropriate process such as presenting an appropriate message on a display unit to inform the operator.

In addition, while some errors require continuous processing of media by the media processing device, by reporting to the control device that the next medium stored in the storage unit can be processed when the portion of the image that will fit in the recording area is recorded, this aspect of the invention enables the control device to continue control appropriate to processing media continuously. As a result, continuous processing of media continues, and a drop in throughput can be suppressed.

When the length of the image is greater than the length of the recording area and the part of the image that will fit in the recording area is recorded in another aspect of the invention, the process control unit discards the portion of the original image data that was not recorded.

This aspect of the invention enables memory to be used more efficiently than when the portion of the original image data that was not recorded is kept stored in a specific storage area.

A media processing device according to another aspect of the invention also has a reading unit that is disposed to the conveyance path and reads the medium conveyed by the conveyance unit. The process control unit controls the switching unit, conveyance unit, recording unit, and reading unit, and continuously applies to the plural media stored in the storage unit a process including conveyance from the storage unit through the conveyance path to the discharge unit, using the recording unit to record on the medium being conveyed, and using the reading unit to read the medium being conveyed.

In devices such as the media processing device according to the invention that read media in addition to recording on the conveyed media, whether or not reading the medium is read successfully is most important, and there are situations in which part of the image not being recorded is allowable. In such situations, continuing execution of continuous processing is advantageous from the perspective of improved processing efficiency even if part of an image is not recorded. As a result, instead of not recording any of the image on the medium when the length of the image to be recorded on the medium being processed is greater than the recording area of that medium, this aspect of the invention prevents executing the recording operation when the medium is not set to the recording position, and records the part of the image that will fit in the recording area. The situations described above can therefore be handled appropriately and processing efficiency can be improved because continuous execution of a process including reading the medium can continue.

Another aspect of the invention is a method of controlling a media processing device that can connect to a control device and has a storage unit that can hold a plurality of media, a conveyance path that connects to the storage unit and conveys the media, a plurality of discharge units that can connect to the conveyance path and receive media discharged from the conveyance path, a switching unit that changes the discharge unit into which the media are discharged, a conveyance unit that conveys the media from the storage unit through the conveyance path to the discharge unit, and a recording unit that is disposed to the conveyance path and records on the media conveyed by the conveyance unit. The control method includes steps of: recording the part of the image that will fit in the recording area with the recording unit, causing the switching unit to change the discharge unit so that media are discharged into different discharge units depending on whether the length of the recording area is shorter or longer than the image length, and conveying the next medium stored in the storage unit with the conveyance unit when the length in the conveyance direction of an image to be recorded on the medium is greater than the length of a recording area determined by the length of the medium in the conveyance direction.

Because only the part of the image that will fit in the recording area is recorded on the medium being processed when the length in the conveyance direction of the image to be recorded is greater than the length of the recording area, this aspect of the invention can reliably prevent the recording operation from executing when the recording medium is not set to the recording position. In addition, because media recorded with the part of the image that will fit in the recording area are discharged into a different discharge unit than the other media, such media can be obviously separated from the other media. In addition, because the length in the conveyance direction of the image recorded to one medium being greater than the length of the recording area on that medium is not treated as an error that causes processing to stop, and the next medium in the storage unit is conveyed and media processing continues in such cases, a drop in throughput can be effectively suppressed.

Furthermore, when the length in the conveyance direction of the image to be recorded on the medium being processed is greater than the length of the recording area of the medium, the part of the image that will fit in the recording area is recorded and executing the recording operation when the medium is not at the recording position is prevented instead of not recording any part of the image on the medium. Because there are situations in which not recording part of the image is allowable depending upon the properties of the image recorded on the medium, this aspect of the invention can appropriately handle such cases.

Another aspect of the invention is a recording medium storing a program that is executed by a control unit that controls parts of a media processing device that can connect to a control device and includes a storage unit that can hold a plurality of media, a conveyance path that connects to the storage unit and conveys the media, a plurality of discharge units that can connect to the conveyance path and receive media discharged from the conveyance path, a switching unit that changes the discharge unit into which the media are discharged, a conveyance unit that conveys the media from the storage unit through the conveyance path to the discharge unit, and a recording unit that is disposed to the conveyance path and records on the media conveyed by the conveyance unit. The program causes the control unit to control the switching unit, conveyance unit, and recording unit; and when the length in the conveyance direction of an image to be recorded on the medium is greater than the length of a recording area determined by the length of the medium in the conveyance direction, record the part of the image that will fit in the recording area with the recording unit, cause the switching unit to change the discharge unit so that media are discharged into different discharge units depending on whether the length of the recording area is shorter or longer than the image length, and convey the next medium stored in the storage unit with the conveyance unit.

Because by executing this program only the part of the image that will fit in the recording area is recorded on the medium being processed when the length in the conveyance direction of the image to be recorded is greater than the length of the recording area, this aspect of the invention can reliably prevent the recording operation from executing when the recording medium is not set to the recording position. In addition, because media recorded with the part of the image that will fit in the recording area are discharged into a different discharge unit than the other media, such media can be obviously separated from the other media by executing this program. In addition, because the length in the conveyance direction of the image recorded to one medium being greater than the length of the recording area on that medium is not treated as an error that causes processing to stop, and the next medium in the storage unit is conveyed and media processing continues in such cases, a drop in throughput can be effectively suppressed.

Furthermore, when the length in the conveyance direction of the image to be recorded on the medium being processed is greater than the length of the recording area of the medium, the part of the image that will fit in the recording area is recorded and executing the recording operation when the medium is not at the recording position is prevented by executing this program instead of not recording any part of the image on the medium. Because there are situations in which not recording part of the image is allowable depending upon the properties of the image recorded on the medium, this aspect of the invention can appropriately handle such cases.

EFFECT OF THE INVENTION

The invention can segregate media that are processed to reliably prevent executing a recording operation when media is not set to the recording position from other media, and suppress a drop in media processing throughput.

Other objects and attainments together with a fuller understanding of the invention will become apparent and appreciated by referring to the following description and claims taken in conjunction with the accompanying drawings.

DESCRIPTION OF EMBODIMENTS

A preferred embodiment of the present invention is described below with reference to the accompanying figures.

Figure 1:
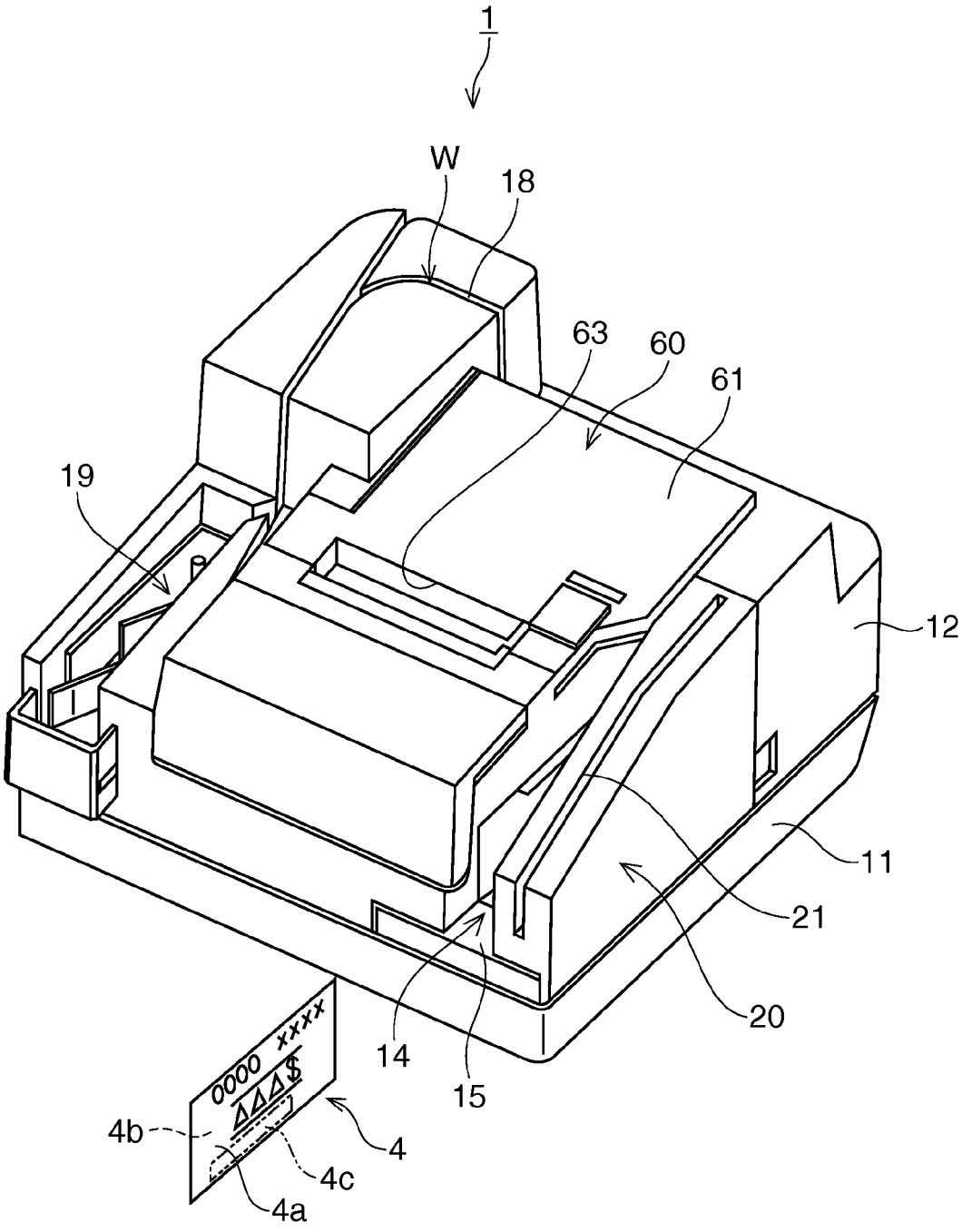
FIG. 1 is an external oblique view of a multifunction device.

FIG. 1 is an oblique view of a multifunction device 1 (media processing device) according to this embodiment of the invention.

The multifunction device 1 is a device that can process media such as checks 4 (media) and other forms in multiple ways, including reading magnetic ink characters printed on the processed medium, optically imaging (scanning) both sides of the processed medium, and recording (printing) images on the processed medium. The multifunction device 1 also functions as a card reader that reads magnetic information recorded on card media such as credit cards, and functions to produce specific types of tickets with an image recorded thereon by recording an image to thermal roll paper and cutting the paper.

This embodiment of the invention describes processing checks 4 as an example of the processed medium. As shown in FIG. 1, a check 4 is a form having a payment amount, payee, serial number, payer signature, and other information printed or recorded on a sheet (paper) with a specific colored or patterned background. The payment amount, payee, serial number, payer signature, and other information are recorded on the face 4*a*, and an endorsement area is provided on the back 4*b* of the check 4. A specific endorsement image is recorded in the endorsement area by an inkjet head 10 described below. An MICR line 4*c* is printed along the length of the check 4 on the face 4*a*. The MICR line 4*c* is a line of magnetic ink characters printed with magnetic ink, and can be read magnetically and optically.

The lengths of the short and long sides of a check 4 are standardized, but can be of various different sizes because there are different standards. The multifunction device 1 defines a maximum check size that includes substantially all commonly used sizes of checks 4, and can process any check 4 within this maximum size.

The outside case of the multifunction device 1 includes a bottom case 11 that covers the bottom part of the multifunction device 1, and a cover 12 that covers the bottom case 11, and the main unit 13 (FIG. 2) of the multifunction device 1 is housed inside this outside case. An entrance 14 for inserting checks 4 is open at the front of the multifunction device 1, and a stacker 15 (storage unit) that can hold a stack of plural checks 4 is provided inside the entrance 14. The stacker 15 can be pulled out to the front, and the checks 4 can be loaded into the stacker 15 after adjusting the stacker 15 to the size of the checks 4 to be stored in the stacker 15.

A slot 18 that is substantially U-shaped when seen from above and is used as the conveyance path W of the checks 4 is formed in the cover 12. The slot 18 communicates with the stacker 15, and the slot 18 communicates with an exit pocket 19 (discharge unit) at the front of the multifunction device 1. Checks 4 stored in the stacker 15 are fed one by one into the multifunction device 1 as described below, are processed as they pass through the slot 18, and the processed checks 4 are discharged into the exit pocket 19. Multiple checks 4 can accumulate in the exit pocket 19.

As shown in FIG. 1, a magnetic card reader 20 is disposed beside the stacker 15. The magnetic card reader 20 includes a card slot 21 formed in the cover 12, and a MCR (magnetic card reader) head 22 (FIG. 3) disposed facing the card slot 21, and reads information magnetically recorded on cards passing through the card slot 21 with the MCR head 22.

Figure 2:
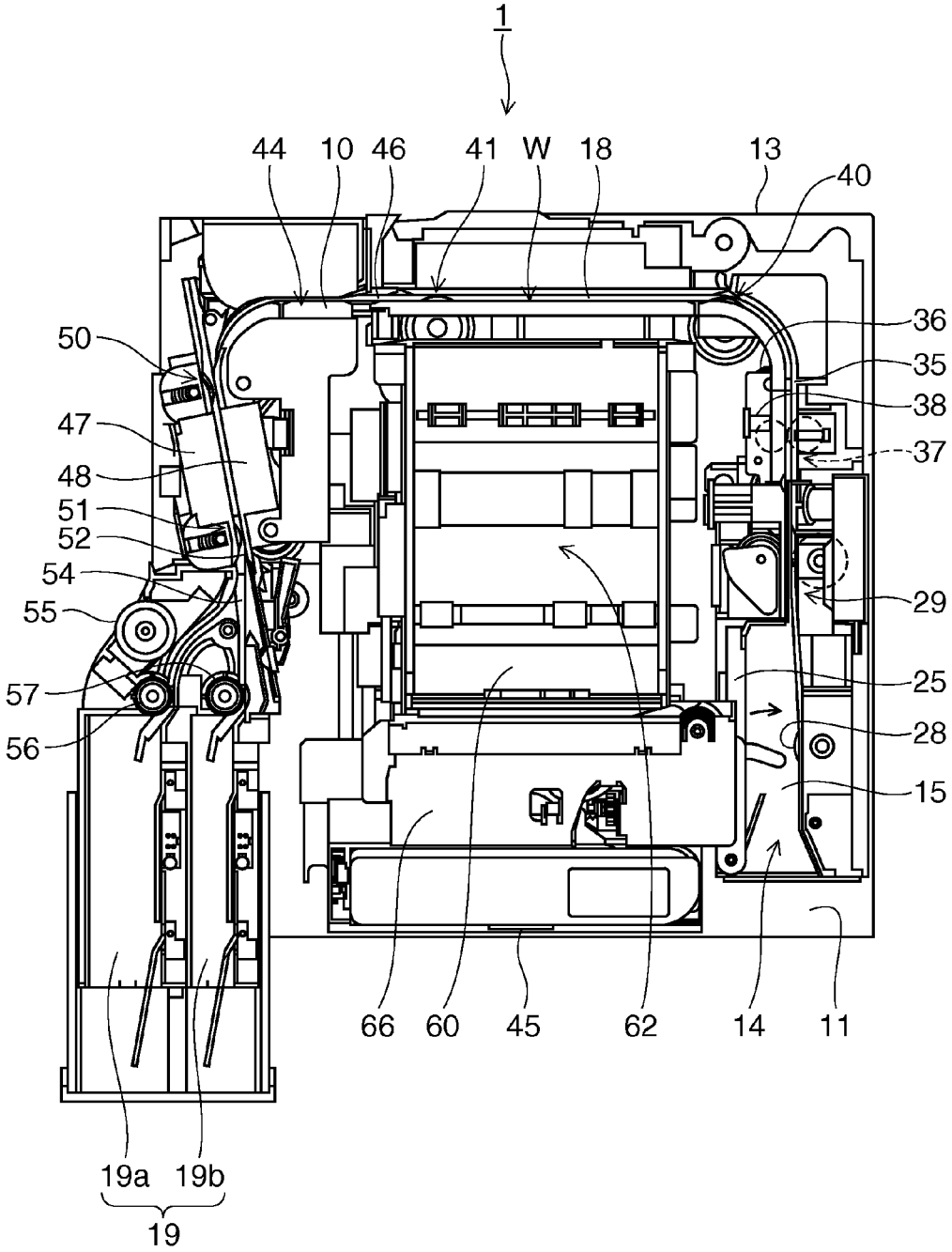
FIG. 2 shows the internal configuration of the multifunction device.

FIG. 2 is a plan view showing the configuration of the main unit 13 of the multifunction device 1 housed the outside case. A hopper 25 is disposed on one side of the stacker 15. The hopper 25 can pivot in the direction of the arrow by means of a hopper drive motor 26 (FIG. 3), and pushes the checks 4 in the stacker 15 to the other side.

A pickup roller 28 driven by an ASF (automatic sheet feeder) motor 27 (FIG. 3) described below is disposed on the other side of the stacker 15, and when the hopper 25 rotates toward the pickup roller 28, one check 4 in the stacker 15 is urged by the rotating hopper 25 to the pickup roller 28, contacts the roller, and is fed into the conveyance path W by rotation of the pickup roller 28.

An ASF roller set 29 composed of a pair of rollers is disposed downstream from the stacker 15. The two rollers of the ASF roller set 29 are disposed on opposite sides of the conveyance path W, one roller is driven by the ASF motor 27, and the other roller is a follower roller. The check 4 in contact with the pickup roller 28 is nipped by the ASF roller set 29, and conveyed downstream through the slot 18.

An ASF paper detector 31 (FIG. 3) is disposed to a specific position in the stacker 15. The ASF paper detector 31 is a transmissive photosensor in this embodiment, and detects if a check 4 is in the stacker 15.

A hopper position detector 32 (FIG. 3) is disposed at the standby position of the hopper 25 in the stacker 15. The hopper position detector 32 is a transmissive photosensor in this embodiment, and detects if the hopper 25 is in the standby position.

A MICR (magnetic ink character recognition) head 35 that contacts the face 4*a* of the check 4 and magnetically reads the MICR line 4*c* (FIG. 1) is disposed downstream from the ASF roller set 29. A MICR roller 36 is disposed opposite the MICR head 35. The MICR roller 36 is pushed to the MICR head 35 side, rotates while pressing the check 4 against the MICR head 35, and conveys checks 4 at a constant speed suited to reading the MICR line. An assist roller set 37 composed of a pair of rollers that guide the check 4 fed by the ASF roller set 29 to the MICR head 35 is disposed on the upstream side of the MICR head 35.

A paper length detector 38 is disposed to the conveyance path W between the assist roller set 37 and MICR head 35. The paper length detector 38 is a reflective photosensor in this embodiment, and detects the leading end and trailing end of each check 4 by detecting if a check 4 passing through the conveyance path W is at the detection position. The control unit 70 acquires the output signals of the paper length detector 38 and determines the length of the check 4 based on change in detector output.

A first conveyance roller set 40 including a pair of rollers disposed on opposite sides of the conveyance path W is disposed to the conveyance path W on the downstream side of the MICR head 35, and a second conveyance roller set 41 is disposed downstream from the first conveyance roller set 40. The first conveyance roller set 40 and second conveyance roller set 41 are driven rotationally by a conveyance motor 42 (FIG. 3), and these rollers convey the check 4 to the inkjet printer unit 44.

The inkjet printer unit 44 has an inkjet head 10. The inkjet head 10 is an inkjet recording head that is supplied with ink from an ink cartridge 45 installed in the front part of the main unit 13 and ejects ink onto the check 4. The inkjet head 10 is an inkjet line head. When recording on a check 4, ink is ejected from the stationary inkjet head 10 to the back 4*b* of the check 4 conveyed at a constant speed, and an image is recorded. The image recorded on the back 4*b* of the check 4 is an endorsement including text or symbols.

An intermediate detector 46 (sensor) is disposed on the upstream side of the inkjet head 10 between the inkjet head 10 and second conveyance roller set 41. The intermediate detector 46 is a reflective photosensor in this embodiment, and detects if a check 4 is at the detection position.

A CIS (contact image sensor) unit for optically reading checks 4 is disposed downstream from the inkjet head 10. This CIS unit includes a front CIS unit 47 for imaging the face 4*a* of the check 4, and a back CIS unit 48 for imaging the back 4*b*, and can thus optically image both sides of each check 4. The front CIS unit 47 and back CIS unit 48 are disposed on opposite sides of the conveyance path W. A first CIS roller 50 is disposed on the upstream side and a second CIS roller 51 is disposed on the downstream side of these units. The first CIS roller 50 and second CIS roller 51 are rollers that are driven rotationally by the conveyance motor 42, and checks 4 are conveyed by these rollers at a constant speed while being imaged by the CIS units.

A discharge detector 52 is located downstream from the second CIS roller 51. The discharge detector 52 is a reflective photosensor in this embodiment, and detects if a check 4 is at the detection position.

The exit pocket 19 described above is located downstream from the front CIS unit 47 and back CIS unit 48. The exit pocket 19 is divided into a main pocket 19*a* (discharge unit) and a sub-pocket 19*b* (discharge unit), and the slot 18 splits and is connected to both the main pocket 19*a* and sub-pocket 19*b*. The main pocket 19*a* and sub-pocket 19*b* can each hold a plurality of checks 4.

A flapper 54 that switches the exit pocket 19 into which the check 4 is discharged to the main pocket 19*a* or sub-pocket 19*b* is disposed at the position where the slot 18 splits. The flapper 54 is a guide that by closing the path to the main pocket 19*a* or the path to the sub-pocket 19*b* guides the check 4 into the other pocket, and is driven by the flapper drive motor 55.

A discharge roller 56 is disposed to the path from the flapper 54 to the main pocket 19*a*, another discharge roller 57 is disposed to the path from the flapper 54 to the sub-pocket 19*b*, and the checks 4 are thus smoothly discharged by these rollers and guided by the flapper 54 into the appropriate exit pocket 19.

As described below, the multifunction device 1 discharges the check 4 into the main pocket 19*a* when the check 4 is determined to have been correctly loaded based on the result of the MICR head 35 reading the MICR line 4*c*, and into the sub-pocket 19*b* when the check 4 is determined to have not been correctly loaded.

As shown in FIG. 1 and FIG. 2, a thermal printer unit 60 for printing tickets with an image recorded thereon is provided in the middle of the multifunction device 1.

A shown in FIG. 1, the thermal printer unit 60 has a printer cover 61 covering the top of the unit. This printer cover 61 is attached to the cover 12 so that the printer cover 61 can open and close freely. When the printer cover 61 is open, a roll paper compartment 62 (FIG. 2), which is a space for holding thermal roll paper, is exposed and the thermal roll paper can be installed or replaced. A paper exit 63 is formed in the printer cover 61, and the thermal roll paper held in the roll paper compartment 62 can be discharged through the paper exit 63.

The thermal printer unit 60 includes a roller platen (not shown in the figure) that supplies and feeds thermal roll paper from the roll paper compartment 62 through the conveyance path, a thermal head 65 (FIG. 3) disposed opposite the platen, and a cutter unit 66 that cuts the thermal roll paper perpendicularly to the conveyance direction. To produce a ticket, the thermal printer unit 60 records an image on the thermal roll paper with the thermal head 65 while driving the platen and conveying the thermal roll paper in the conveyance direction, and then cuts the thermal roll paper at a specific position with the cutter unit 66 to produce a ticket.

Figure 3:
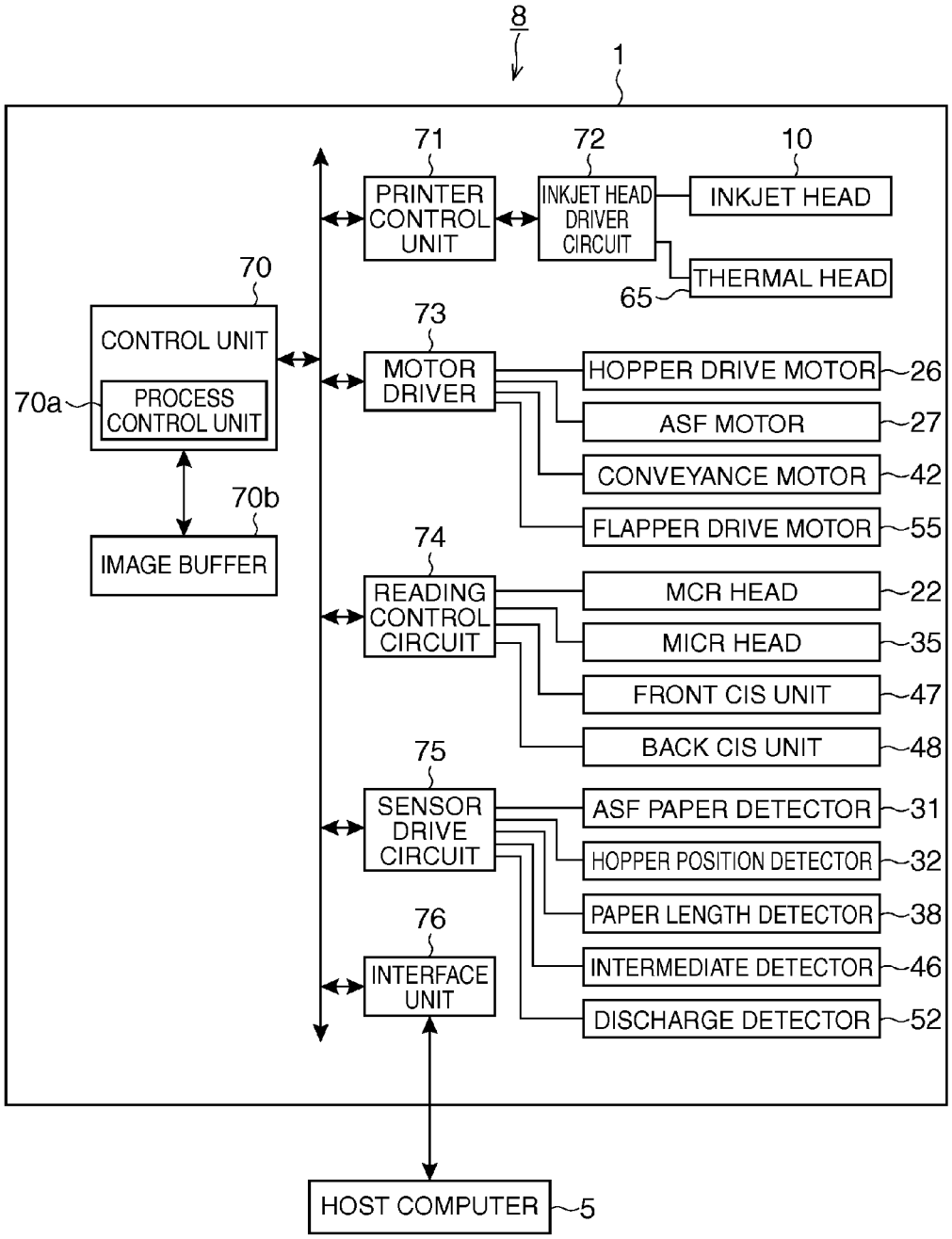
FIG. 3 is a block diagram showing the functional configuration of the multifunction device.

FIG. 3 is a block diagram showing the functional configuration of a reading system 8 composed of the multifunction device 1 connected to a host computer 5 (control device).

The multifunction device 1 has a control unit 70 including a CPU that controls the multifunction device 1, RAM, and flash ROM; a printer control unit 71 that controls an inkjet printer unit 44 and thermal printer unit 60; a head driver circuit 72, motor driver 73, reading control circuit 74, sensor drive circuit 75, and interface unit 76. These various units are connected so that they can communicate with each other.

The control unit 70 controls other parts of the multifunction device 1 by means of the CPU reading and running a control program stored in flash ROM. The control unit 70 also has a process control unit 70*a* further described below. An image buffer 70*b* described below is also connected to the control unit 70.

The printer control unit 71 supplies drive current to the inkjet head 10 through the head driver circuit 72 to print on a check 4 as controlled by the control unit 70. The control unit 70, printer control unit 71, head driver circuit 72, and other devices and mechanisms cooperate and function as a recording unit that prints on checks 4 (media) conveyed by the conveyance unit through the conveyance path W.

The printer control unit 71 also supplies drive current to the thermal head 65 through the head driver circuit 72 to print on thermal roll paper as controlled by the device-side control unit 70.

The motor driver 73 is connected to the hopper drive motor 26 and causes the hopper 25 to pivot as controlled by the control unit 70. The motor driver 73 is also connected to the ASF motor 27 and conveyance motor 42, outputs drive current and drive pulses to the motors, and operates the motors and drives the rollers connected to the motors as controlled by the control unit 70.

The control unit 70, motor driver 73, hopper drive motor 26, hopper 25, ASF motor 27, conveyance motor 42, the rollers connected to the motors, and other mechanisms and devices cooperate and function as a conveyance unit that conveys media stored in the stacker 15 (storage unit) through the conveyance path W communicating with the stacker 15 (storage unit), and discharges the media into the main pocket 19*a* or sub-pocket 19*b* (two discharge units), each of which connects to the conveyance path W.

The motor driver 73 is connected to the flapper drive motor 55, and outputs drive current and drive pulses to the motor as controlled by the control unit 70 to move the flapper 54 to change the exit pocket 19 into which the check 4 is discharged to the main pocket 19*a* side or the sub-pocket 19*b* side. The control unit 70, motor driver 73, flapper drive motor 55, and flapper 54 cooperate and function as a switching unit that changes the exit pocket 19 (discharge unit) into which each check 4 (medium) is discharged.

The reading control circuit 74 is connected to the MCR head 22, MICR head 35, front CIS unit 47, and back CIS unit 48. The reading control circuit 74 causes the MCR head 22 to read the magnetic information when a card is swiped through the card slot 21 (FIG. 1), and digitizes and outputs the read signal output from the MCR head 22 to the control unit 70 as controlled by the control unit 70.

The reading control circuit 74 also reads magnetic information with the MICR head 35, and digitizes and outputs the read signal output from the MICR head 35 to the control unit 70 as controlled by the control unit 70. As controlled by the control unit 70, the reading control circuit 74 drives the front CIS unit 47 and back CIS unit 48 to scan the face 4*a* and back 4*b* of the check 4, and digitizes and outputs the signals output from the front CIS unit 47 and back CIS unit 48 to the control unit 70.

The control unit 70, reading control circuit 74, front CIS unit 47 and back CIS unit 48, and other mechanisms and devices work together and function as a reading unit that reads the checks 4 (media) conveyed by the conveyance unit through the conveyance path W.

The sensor drive circuit 75 is connected to the ASF paper detector 31, hopper position detector 32, paper length detector 38, intermediate detector 46, and discharge detector 52, supplies current to these detectors, gets the output values therefrom at specific times, and digitizes and outputs the acquired detection signals to the control unit 70.

The interface unit 76 is connected to the host computer 5 by wire or wirelessly, and exchanges data, including control data, with the host computer 5 as controlled by the control unit 70.

The basic operation of the multifunction device 1 when processing a check 4 is described below.

As described above, a plurality of checks 4 can be stored in the stacker 15. At specific times, the multifunction device 1 according to this embodiment of the invention sequentially feeds the plural checks 4 in the stacker 15 through the conveyance path W, and can continuously perform the process described below on each check 4.

Figure 4:
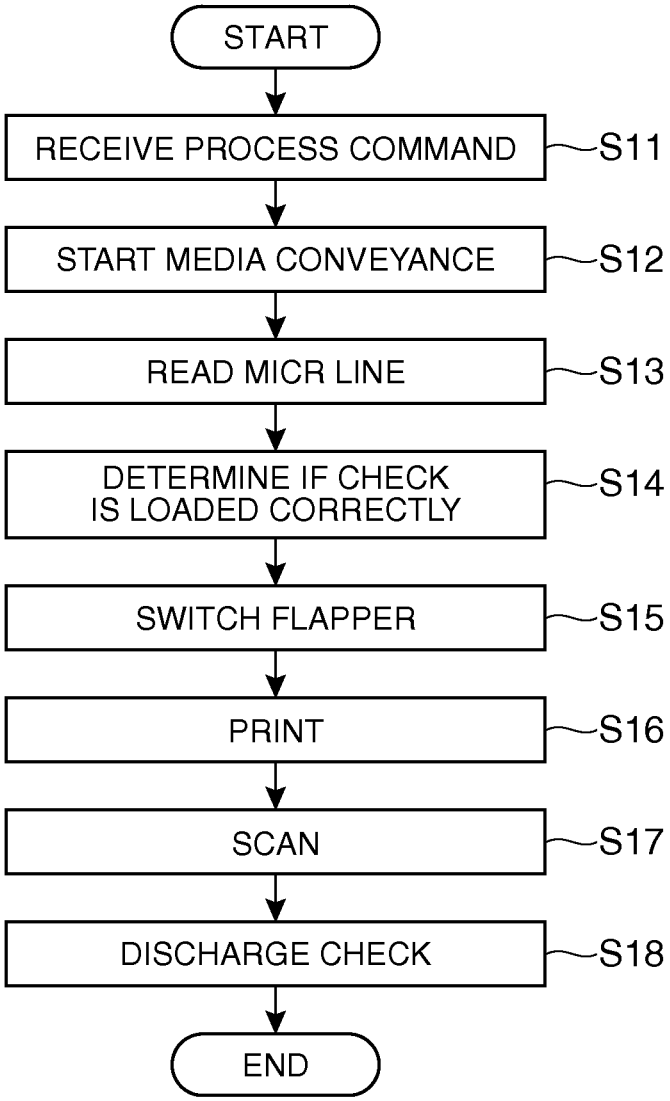
FIG. 4 is a flow chart of the operation of the multifunction device.

FIG. 4 is a flow chart showing the process applied to a single check 4.

When a command to start processing a check 4 is received from the host computer 5 (step S11), the process control unit 70*a* of the control unit 70 of the multifunction device 1 drives the hopper drive motor 26 and ASF motor 27 while monitoring the output values of the hopper position detector 32 and ASF paper detector 31, feeds one of the checks 4 stored in the stacker 15 into the conveyance path W, and starts check 4 conveyance (step S12).

The function of the process control unit 70*a* is achieved by the cooperation of hardware and software, such as a CPU reading and running a program from firmware.

Next, the process control unit 70*a* reads the MICR line 4*c* of the check 4 with the MICR head 35 while managing the position of the check 4 by monitoring the output from the paper length detector 38 (step S13).

The process control unit 70*a* then determines if the check 4 was loaded correctly instead of backwards top-bottom or front-back based on reading output of the MICR head 35 (step S14). More specifically, the process control unit 70*a* applies magnetic ink character recognition to the magnetic ink characters in the MICR line 4*c* by comparing the waveforms obtained by reading the magnetic ink characters with standard waveforms, and determines if the check 4 was loaded correctly or not based on whether or not magnetic ink character recognition is successful.

Next, the process control unit 70*a* drives the flapper drive motor 55 to switch the flapper 54 based on the result from step S14 (step S15). More specifically, if the check 4 was loaded correctly, the control unit 70 switches the flapper 54 to the main pocket 19*a* side, and if the check 4 was not loaded correctly, the control unit 70 switches the flapper 54 to the sub-pocket 19*b* side. Note that steps S14 and S15 could run parallel to steps SA6 and S17 described below.

Next, the process control unit 70*a* drives the rollers by driving the conveyance motor 42 to convey the check 4 while monitoring the position of the check 4 by monitoring output from the intermediate detector 46, and records a specific image on the back 4*b* of the check 4 with the inkjet head 10 (step S16). Note that if the check 4 was not loaded correctly, recording an image in step S16 may be skipped.

The process control unit 70*a* then scans the face 4*a* of the check 4 with the front CIS unit 47 while scanning the back 4*b* with the back CIS unit 48, and outputs the results of scanning to the host computer 5 (step S17). Note that if the check 4 was not loaded correctly, scanning in step S17 may be skipped.

The control unit 70 then drives the rollers by driving the conveyance motor 42 to discharge the check 4 into the exit pocket 19 while monitoring whether or not the check 4 was discharged correctly by monitoring the output of the discharge detector 52 (step S18). The check 4 is guided at this time by the flapper 54 into the appropriate exit pocket 19, that is, the main pocket 19*a* or sub-pocket 19*b*, based on the result of reading by the MICR head 35.

Recording on a check 4 with the inkjet head 10 is described in detail next.

To record an image on a check 4, a control command for recording a specific image on the check 4 is first input from the host computer 5 to the multifunction device 1. Image data for the image to be recorded on the check 4 (bitmap data or other data storing information related to the color of each pixel) is included in this control command. When the control command is input, the process control unit 70*a* writes the image data contained in the control command to an image buffer 70*b*, and then records the image as described below based on the buffered image data.

Figure 5:
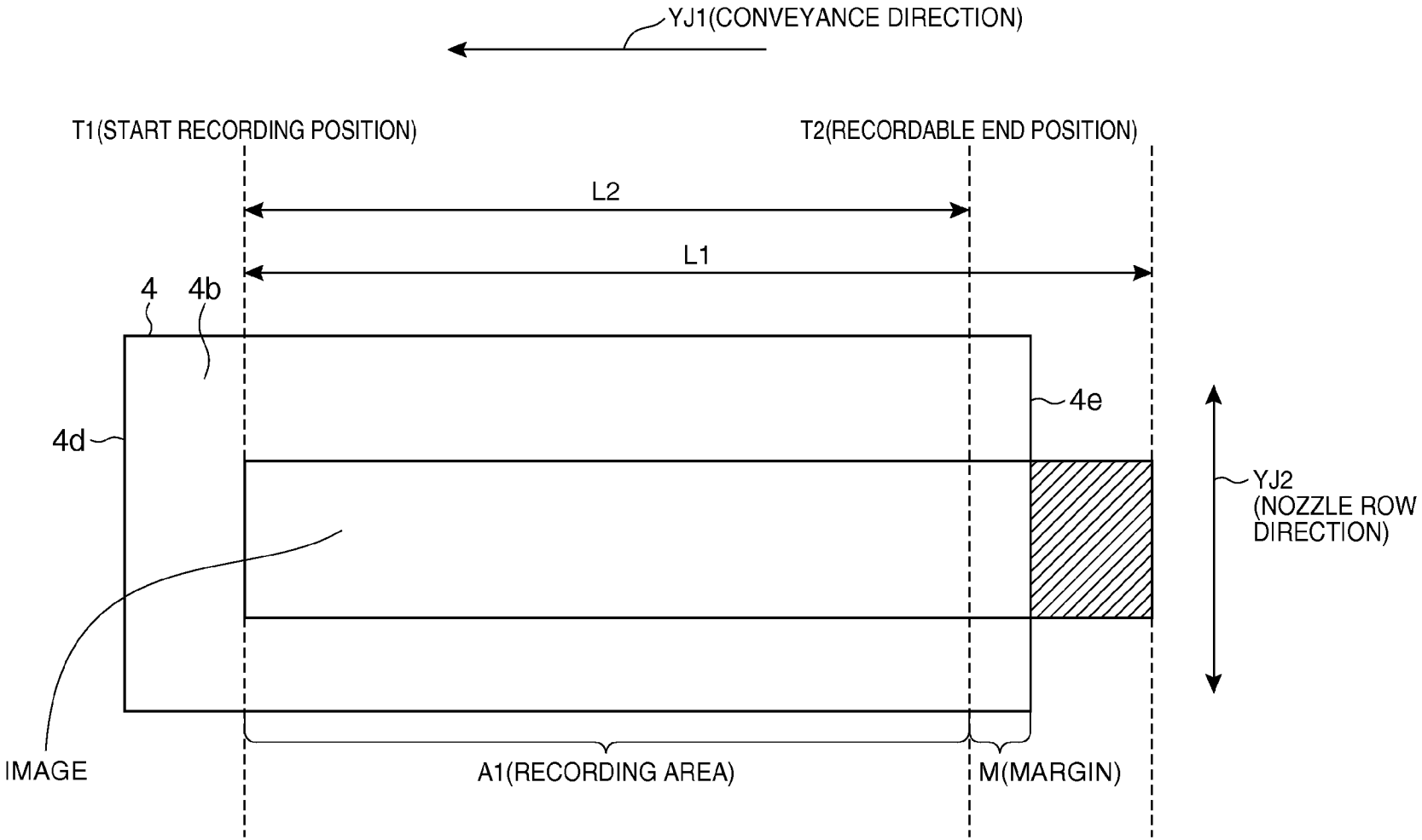
FIG. 5 shows a check used to describe the operation of recording on a check.

FIG. 5 is used to describe operation when recording an image on the check 4, and schematically shows the back 4*b* of the check 4 (the side on which the image is recorded).

In the check 4 shown in FIG. 5 the edge on the left side is the leading end 4*d*, the edge on the right side is the trailing end 4*e*, and the check 4 is conveyed through the conveyance path W in conveyance direction YJ1 (the direction from the stacker 15 to the exit pocket 19 in the conveyance path W).

The inkjet head 10 has one or a plurality of nozzle rows each including a plurality of nozzles formed in nozzle row direction YJ2 (that is, the short side of the conveyed check 4) intersecting the conveyance direction YJ1.

To record an image, the process control unit 70*a* drives the conveyance motor 42 and other mechanisms to convey the check 4 at a constant speed in the conveyance direction YJ1 in FIG. 5. The process control unit 70*a* records an image by forming groups of dots on the back 4*b* of the check 4 by ejecting a specific amount of ink from specific nozzles in the nozzle row at specific times based on the image data written to the image buffer 70*b* while conveying the check 4 in the conveyance direction YJ1.

When recording an image on one check 4, the length ("image length L1" below) in the conveyance direction YJ1 of the image represented by the image data input from the host computer 5 to the multifunction device 1 for recording on the one check 4 is normally less than or equal to the length in the conveyance direction YJ1 of the recording area A1 of the check 4 ("recording area length L2" below). As shown in FIG. 5, the recording area A1 is the area from the start recording position T1 on the back of the check 4 (the position from which recording an image starts at the leading end of the check 4) to the recordable end position T2 (a position separated margin M from the trailing end 4*e* of the check 4). Margin M is the minimum margin required to reliably prevent ink from being ejected past the trailing end 4*e* of the check 4 when recording an image on the check 4. The recording area length L2 is determined by the length of the check 4 in the conveyance direction.

If the image length L1 is greater than the recording area length L2 and some corrective action is not taken, ink will be ejected outside of the check 4 when recording an image as shown by the shaded area in FIG. 5, soiling the device and the check 4 conveyed next, and possibly creating other problems in the mechanisms and device.

In rare cases, however, the image length L1 of the image represented by the image data input from the host computer 5 may be greater than the recording area length L2 of the processed check 4 due to operator error or other cause. Because such cases will also result in soiling or other problem, reliably preventing ink from being ejected outside of the check 4 is necessary.

Executing a special process to prevent ejection of ink outside the check 4 when the image length L1 is greater than the recording area length L2 of the check 4 being processed is also conceivable. When such a special process is performed, such checks 4 must be clearly segregated from the other checks 4 so that the specially processed media can be removed later.

As described above, the multifunction device 1 can continuously process plural checks 4 stored in the stacker 15. By thus enabling continuously processing multiple checks 4, the time required to process multiple checks 4 can be shortened, the product value and usefulness of the multifunction device 1 can be improved, and customer satisfaction and convenience can be improved. Suppressing an unnecessary drop in throughput by the multifunction device 1 is therefore strongly desired.

The multifunction device 1 according to this embodiment of the invention therefore operates as described below.

Figure 6:
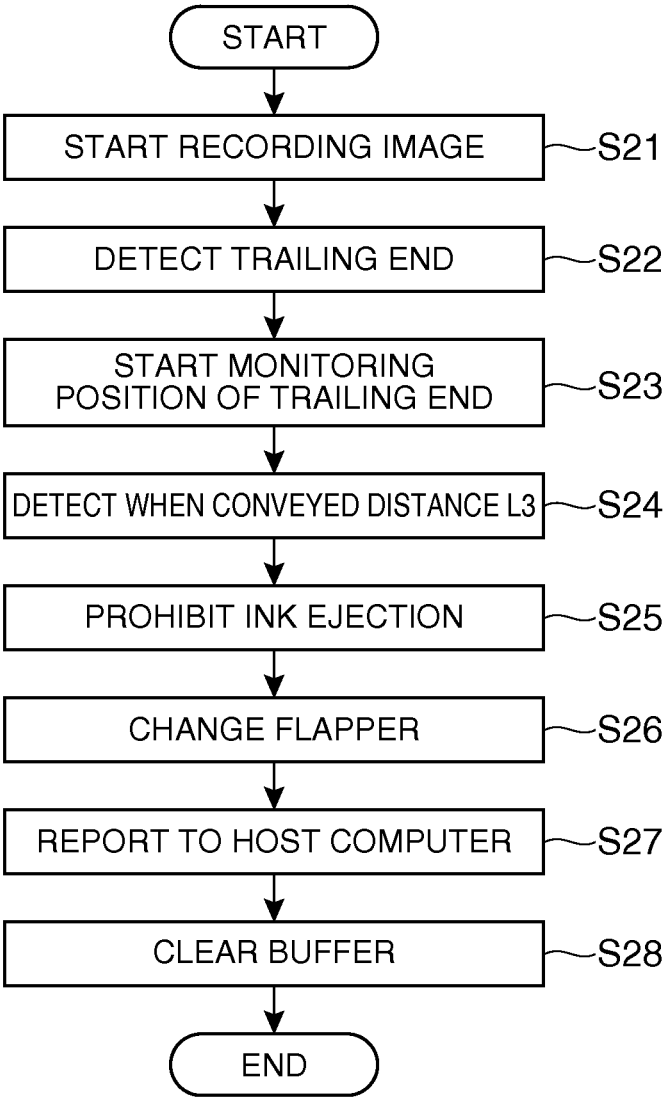
FIG. 6 is a flow chart of the operation of the multifunction device.

FIG. 6 is a detailed flow chart of the operation of the multifunction device 1 when recording an image on a check 4 in step S16 in FIG. 4. FIG. 7 is used to describe the operation shown in the flow chart in FIG. 6.

To simplify the following description, the image length L1 of the image to be recorded on the check 4 is greater than the recording area length L2 of the check 4 being processed.

Referring to FIG. 6, the process control unit 70*a* of the control unit 70 of the multifunction device 1 starts recording an image by ejecting ink from the nozzle row of the inkjet head 10 while conveying the check 4 in the conveyance direction YJ1 based on a control command input from the host computer 5 (step S21). The process control unit 70*a* conveys the check 4 at a constant speed while recording an image on the check 4.

Figure 7A:
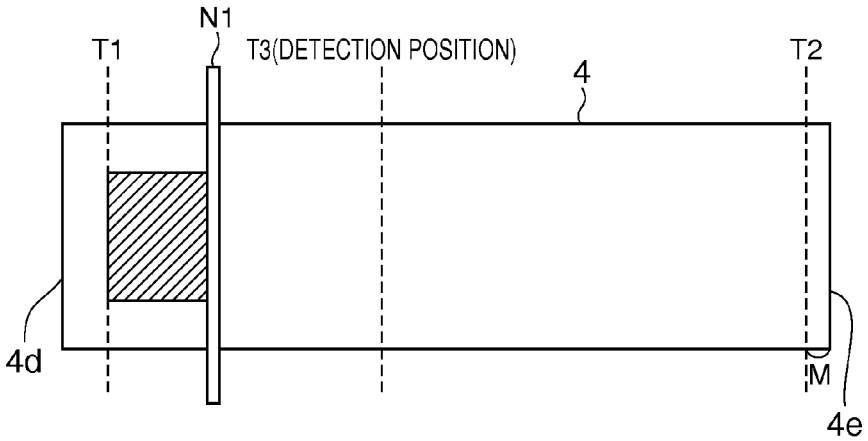
FIGS. 7A, 7B and 7C are used to describe operation of the multifunction device in conjunction with the flow chart in FIG. 6.

FIG. 7A schematically shows the relationship between the check 4 immediately after starting image recording, the nozzle row N1, and the detection position T3 where the intermediate detector 46 detects if a check 4 is present. Note that only one nozzle row is shown in FIG. 7, but plural nozzle rows could be disposed to the inkjet head 10.

As shown in FIG. 7A, immediately after starting image recording, the trailing end 4*e* of the check 4 is on the upstream side of the detection position T3 in the conveyance direction YJ1, and dots are sequentially formed by the nozzle row N1 from the start recording position T1 to record the image.

As image recording advances and check 4 conveyance in the conveyance direction YJ1 continues, the trailing end 4*e* of the check 4 reaches the detection position T3. When the trailing end 4*e* of the check 4 reaches the detection position T3, the process control unit 70*a* detects the trailing end 4*e* based on change in the output of the intermediate detector 46 (step S22).

Figure 7B:
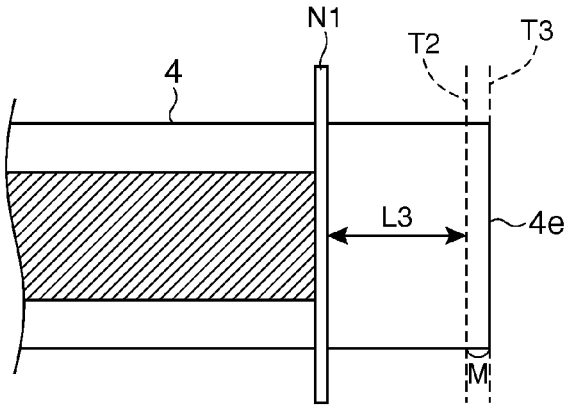

FIG. 7B schematically shows the relationship between the check 4, the nozzle row N1, and the detection position T3 when the trailing end 4*e* of the check 4 reaches the detection position T3.

As shown in FIG. 7B, when the trailing end 4*e* of the check 4 reaches the detection position T3, the distance between the recordable end position T2 of the check 4 and the nozzle row N1 is distance L3, which is a constant value. As a result, the recordable end position T2 reaches the nozzle row N1 when the check 4 is conveyed distance L3 after the trailing end 4*e* of the check 4 reaches the detection position T3.

When the trailing end 4*e* of the check 4 reaches the detection position T3 of the intermediate detector 46, the process control unit 70*a* starts managing how much further the check 4 is conveyed (step S23). In this embodiment of the invention the conveyance motor 42 is a stepper motor, and the conveyance distance of the check 4 can be managed based on the number of steps the motor turns. Note that the process control unit 70*a* manages the position of the trailing end 4*e* of the conveyed check 4 by managing the conveyance distance of the check 4.

As image recording continues and the check 4 is conveyed in the conveyance direction YJ1, the process control unit 70*a* determines when the check 4 has been conveyed distance L3 after the trailing end 4*e* of the check 4 reached the detection position T3 of the intermediate detector 46 (step S24).

Figure 7C:
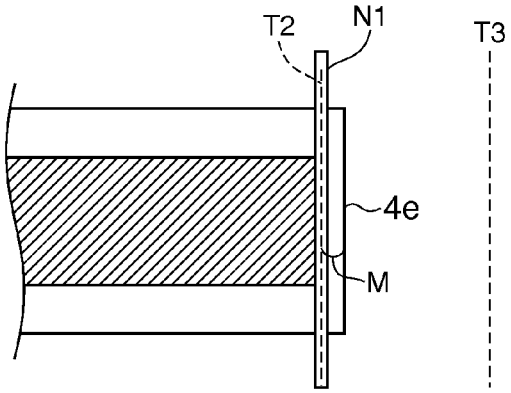

FIG. 7C schematically shows the relationship between the check 4, the nozzle row N1, and the detection position T3 when the check 4 has been conveyed distance L3 after the trailing end 4*e* of the check 4 reached the detection position T3 of the intermediate detector 46.

As shown in FIG. 7C, when the check 4 is conveyed distance L3, the recordable end position T2 of the check 4 reaches the position of the nozzle row N1, and the distance between the nozzle row N1 and the trailing end 4*e* of the check 4 is only margin M. This margin M is the minimum margin required to reliably prevent ink from being ejected past the trailing end 4*e* of the check 4 when recording an image on the check 4.

The process control unit 70*a* prohibits ejecting ink once the check 4 has been conveyed this distance L3 (step S25).

The process control unit 70*a* in this embodiment of the invention thus prohibits further ejection of ink when the check 4 has been conveyed distance L3 after the trailing end 4*e* of the check 4 reaches the detection position T3 of the intermediate detector 46. As a result, ejection of ink on the upstream side of the recordable end position T2 of the check 4 is prohibited, and ejection of ink outside the check 4 is reliably prevented.

When part of the image is not recorded as a result of prohibiting ink ejection in step S25, the process control unit 70*a* switches the flapper 54 to the sub-pocket 19*b* side. If the entire image is recorded before ink ejection is prohibited in step S25 (that is, when the image length L1 is shorter than the recording area length L2), the process control unit 70*a* sets the flapper 54 to the main pocket 19*a* side (step S26).

More specifically, if other conditions are the same, checks 4 on which the entire image is recorded because the image length L1 is shorter than the recording area length L2 are discharged into the main pocket 19*a* in this embodiment, and checks 4 on which part of the image is not recorded because the image length L1 is greater than the recording area length L2 are discharged into the sub-pocket 19*b*. Because checks 4 on which part of the image is not recorded because the image length L1 is greater than the recording area length L2 are discharged into the sub-pocket 19*b*, those checks 4 can be clearly segregated from the other checks 4 on which the entire image is recorded.

The process control unit 70*a* then reports the result of the recording process to the host computer 5 (step S27). In this case, the process control unit 70*a* reports that the part of the image that will fit in the recording area A1 was recorded because the image length L1 is greater than the recording area length L2 of the check 4 on which the image was to be recorded, and processing other checks 4 stored in the stacker 15 can continue. For example, the command output from the process control unit 70*a* to the host computer 5 for this report contains a flag indicating that the image length L1 is greater than the recording area length L2 and the portion of the image that would fit was recorded in the recording area A1, and a flag indicating that continuous processing of other checks 4 in the stacker 15 can continue, and the process control unit 70*a* appropriately sets these flags before outputting the command.

The effect of the process control unit 70*a* reporting that the image length L1 is greater than the recording area length L2 and the portion of the image that would fit within the recording area A1 was recorded, and that continuous processing of other checks 4 stored in the stacker 15 can continue, is described below.

By knowing that the image length L1 is greater than the recording area length L2 and the portion of the image that will fit was recorded in the recording area A1, the host computer 5 can execute an appropriate process such as presenting an appropriate message on the display unit of the host computer 5 to inform the operator.

In addition, while some errors that occur in the image recording process require continuous processing of checks 4 by the multifunction device 1, reporting that continuous processing of other checks 4 stored in the stacker 15 can continue enables the host computer 5 to continue control appropriate to processing media continuously. As a result, continuous processing of checks 4 continues, and a drop in throughput can be suppressed.

While part of the image is not recorded on the check 4 when the image length L1 is greater than the recording area length L2 and only the portion that will fit is recorded the recording area A1, this is not an error that affects any mechanical device or other part and interferes with continuing to process checks 4, and continuous processing of media can continue without interruption as described above. While throughput can drop significantly when continuous processing of plural checks 4 is interrupted, this embodiment of the invention can effectively suppress a drop in throughput because continuous processing is not interrupted unnecessarily.

After reporting to the host computer 5 in step S27, the process control unit 70*a* clears the image buffer 70*b* and discards the portion of the image data written to the image buffer 70*b* that was not printed (step S28). As a result, the image data to be recorded to the next check 4 can be written to the image buffer 70*b* more efficiently than when data is left in the buffer.

When the image length L1 is greater than the recording area length L2 and part of the image cannot be recorded, this embodiment of the invention records as much of the image that will fit in the recording area A1 instead of not recording any of the image. The effect of this is described below.

In devices such as this multifunction device 1 that read checks 4 in addition to recording an endorsement image on the back of the conveyed check 4, whether or not the check 4 is successfully read magnetically and optically is most important, and there are situations in which not recording part of the endorsement image is allowable. In such situations, continuing execution of the continuous process is advantageous from the perspective of improved processing efficiency even if part of the endorsement image is not recorded. As a result, this embodiment of the invention can appropriately handle such situations and improve media processing efficiency when the image length L1 is greater than the recording area length L2 and part of the image cannot be recorded on a particular single check 4 being processed by recording as much of the image that will fit in the recording area A1 and continuing processing other media, instead of not recording any of the image on the medium.

Referring to FIG. 4, after executing the image recording process by executing steps S21 to S28 in FIG. 6 (step S16), the process control unit 70*a* of the multifunction device 1 scans (step S17) and discharges the check 4 into the exit pocket 19 (step S18). At the appropriate time, the process control unit 70*a* of the multifunction device 1 starts conveying the next check 4 stored in the stacker 15, and runs the process shown in FIG. 4. The host computer 5 outputs appropriate control commands at this time based on the multifunction device 1 continuing to process checks 4.

This embodiment of the invention thus starts conveying the next check 4, continues executing the media processing operation, and suppresses a drop in throughput even when the image length L1 is greater than the recording area length L2 and part of the image cannot be recorded on any one check 4.

As described above, when the image length L1 is greater than the recording area length L2 of the check 4 being processed, the process control unit 70*a* according to this embodiment of the invention records that portion of the image that will fit in the recording area A1, changes the exit pocket 19 into which the check 4 is discharged so that the exit pocket 19 into which the check 4 is discharged differs according to whether the recording area length L2 is shorter or longer than the image length L1, and then conveys the next check 4 in the stacker 15.

As a result, because that portion of the image that will fit in the recording area A1 is recorded when the image length L1 is greater than the recording area length L2 of the check 4 being processed, the process control unit 70*a* can reliably prevent ink being ejected from the inkjet head 10 outside of the check 4 (the recording operation when the medium is not at the recording position) in such cases. Furthermore, because checks 4 to which an image is recorded to the extent that will fit in the recording area A1, and checks 4 on which the entire image is recorded, are discharged into different exit pockets 19, this embodiment of the invention can clearly segregate such partially printed checks 4 from the other checks 4. In addition, because processing is not stopped as the result of an error when the image length L1 is greater than the recording area length L2, the next check 4 in the stacker 15 is conveyed, and processing the next check 4 continues, a drop in throughput can be effectively suppressed.

The multifunction device 1 according to this embodiment of the invention has an intermediate detector 46 (sensor) that detects if a check 4 is present disposed on the upstream side of the inkjet head 10. The process control unit 70*a* records the part of the image that will fit in the recording area A1 when the image length L1 is greater than the recording area length L2 by detecting the trailing end 4*e* of the check 4 with the intermediate detector 46, managing the position of the trailing end 4*e*, and prohibiting ejection of ink on the upstream side of the position corresponding to the trailing end 4*e* of the check 4 (the recordable end position T2 leaving margin M).

As a result, because the position of the trailing end 4*e* is monitored after detecting the trailing end 4*e* of the check 4 with the intermediate detector 46, and ejection of ink on the upstream side of the position corresponding to the trailing end 4*e* is prohibited, ejecting ink on the upstream side past the trailing end 4*e* of the check 4 can be reliably prevented by a simple means.

The process control unit 70*a* according to this embodiment of the invention also reports that the image length L1 is greater than the recording area length L2 and the portion of the image that will fit was recorded in the recording area A1, and that the next check 4 in the stacker 15 can be processed, to the host computer 5.

As a result, the host computer 5 can know when the image length L1 is greater than the recording area length L2 and only the portion of the image that will fit was recorded in the recording area A1, and can execute an appropriate process such as presenting an appropriate message on the host computer 5 display unit to inform the operator.

In addition, while some errors that occur in the image recording process require continuous processing of checks 4 by the multifunction device 1, reporting that continuous processing of other checks 4 stored in the stacker 15 can continue enables the host computer 5 to continue control appropriate to processing media continuously. As a result, continuous processing of checks 4 continues, and a drop in throughput can be suppressed.

While part of the image is not recorded on the check 4 when the image length L1 is greater than the recording area length L2 and only the portion that will fit is recorded the recording area A1, this is not an error that affects any mechanical device or other part and interferes with continuing to process checks 4, and continuous processing of media can continue without interruption as described above. While throughput can drop significantly when continuous processing of plural checks 4 is interrupted, this embodiment of the invention can effectively suppress a drop in throughput because continuous processing is not interrupted unnecessarily.

When the image length L1 is greater than the recording area length L2 and only the portion of the image that fits is recorded in the recording area A1, this embodiment of the invention discards the portion of the image data written to the image buffer 70*b* that was not printed.

As a result, the image data to be recorded to the next check 4 can be written to the image buffer 70*b* more efficiently than when data is left in the buffer.

The multifunction device 1 according to this embodiment of the invention has reading units that read checks 4 magnetically and optically. The process control unit 70*a* controls a switching unit, conveyance unit, recording unit, and reading units, and continuously executes a process on the plural checks 4 stored in the stacker 15 including conveyance from the stacker 15 through the conveyance path W to the exit pocket 19, recording an image on the check 4 being conveyed, and reading the check 4 being conveyed.

In devices such as the multifunction device 1 according to this embodiment of the invention that read checks 4 in addition to recording an endorsement image on the back of the conveyed check 4, whether or not a check 4 is successfully read magnetically and optically is most important, and there are situations in which not recording part of the endorsement image is allowable. In such situations, continuing execution of the continuous process is advantageous from the perspective of improved processing efficiency even if part of the endorsement image is not recorded. As a result, this embodiment of the invention can appropriately handle such situations and improve processing efficiency when the image length L1 is greater than the recording area length L2 and part of the image cannot be recorded on any single check 4 being processed by recording as much of the image that will fit in the recording area A1 and continuing processing other media, instead of not recording any of the image on the medium.

Another embodiment of the invention is described next.

When recording an image on a check 4 in the embodiment described above, ejecting ink outside of the check 4 is prevented by detecting the trailing end 4*e* of the check 4 with the intermediate detector 46 to manage the position of the trailing end 4*e*, and prohibiting ejecting ink on the upstream side of a position corresponding to the trailing end 4*e*.

Ejecting ink outside of the check 4 is prevented in another embodiment of the invention as described below.

More specifically, after check 4 conveyance starts, the control unit 70 of the multifunction device 1 detects the length of the long side (that is, the conveyance direction) of the check 4 based on output from the paper length detector 38. The control unit 70 functions as a detection unit in this operation.

The process control unit 70*a* then calculates the recording area length L2 of the recording area A1 from the relationship between the detected length of the long side of the check 4 and the start recording position T1 on the check 4.

When a control command to record an image is received from the host computer 5, the process control unit 70*a* calculates the image length L1 of the image represented by the image data based on the image data contained in the control command.

The process control unit 70*a* then compares the calculated image length L1 and the recording area length L2, and records the entire image if the image length L1 is shorter than the recording area length L2. However, if the image length L1 is longer than the recording area length L2, that part of the image that will fit in the recording area A1 is determined, and this part of the image is recorded. As a result, ejecting ink outside the check 4 can be reliably prevented, and the same effect as the effect of the embodiment described above can be achieved. The part of the image data that was not recorded as an image is deleted and discarded instead of being saved. As a result, the storage area can be used more effectively than when the data is kept in memory.

As described above, the control unit 70 that functions as a detection unit in this embodiment of the invention detects the length of the conveyed check 4 based on output from the paper length detector 38. The process control unit 70*a* then calculates the length L1 of the image to be recorded on the check 4 based on the image data received from the host computer 5, compares the calculated image length L1 and the recording area length L2, which is the length of the recording area A1 determined from the length of the check 4 in the conveyance direction, and if the image length L1 is longer than the recording area length L2, records that part of the image that will fit in the recording area A1.

As a result, the image can be appropriately recorded based on the actual length of the check 4 conveyed through the conveyance path W after determining whether the image length L1 or the recording area length L2 is longer.

The embodiment described above is one example of a preferred embodiment of the invention, and can obviously be changed and adapted in many ways without departing from the scope of the accompanying claims.

For example, images are recorded by ejecting ink with an inkjet head 10 onto a check 4 conveyed through the conveyance path W in the multifunction device 1 described above, but the invention is not limited to using an inkjet head 10, and could be configured to record images on checks 4 with a thermal head or dot impact printhead, for example. More specifically, the invention can be used in all devices in which executing the recording operation should be avoided when a recording medium is not set to the recording position.

For example, the multifunction device 1 in the foregoing embodiment has the MICR head 35, inkjet head 10, and CIS unit disposed in sequence along the conveyance path W, but the order of these devices and the specific configuration of the multifunction device 1 is not so limited.

The function blocks shown in FIG. 3 can also be desirably rendered through the cooperation of software and hardware, and do not suggest a specific hardware configuration.

The function of the control unit 70, for example, can also be provided by a separate device externally connected to the multifunction device 1.

The steps in the flow charts shown in FIG. 4 and FIG. 6 can also be executed by running a program stored to an externally connected storage medium.

The processes of the multifunction device 1 described in the foregoing embodiment can also be provided as a program. This program can be run by the control unit 70 that controls parts of the multifunction device 1. The program can also be supplied stored on a storage medium such as a hard disk drive, optical disk, magneto-optical disk, or flash memory.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. A media processing device that can connect to a control device and comprises:

a storage unit that can hold a plurality of media;

a conveyance path that connects to the storage unit and conveys the media;

a plurality of discharge units that can connect to the conveyance path and receive media discharged from the conveyance path;

a switching unit that changes the discharge unit into which the media are discharged;

a conveyance unit that conveys the media from the storage unit through the conveyance path to the discharge unit;

a recording unit that is disposed to the conveyance path and records on the media conveyed by the conveyance unit; and a process control unit that controls the switching unit, conveyance unit, and recording unit, wherein when the length in the conveyance direction of an image to be recorded on the medium is greater than the length of a recording area determined by the length of the medium in the conveyance direction, the process control unit records the part of the image that will fit in the recording area with the recording unit, causes the switching unit to change the discharge unit so that media are discharged into different discharge units depending on whether the length of the recording area is shorter or longer than the image length, and then conveys the next medium stored in the storage unit with the conveyance unit.

2. The media processing device described in claim 1, further comprising:

a sensor that is disposed on the upstream side of the recording unit and detects the medium;

wherein the process control unit detects the trailing end of the medium with the sensor, and uses the recording unit to record the part of the image that will fit in the recording area, by prohibiting the recording unit from recording an image on the upstream side of a position corresponding to the trailing end of the medium when the length of the image is greater than the length of the recording area.

3. The media processing device described in claim 2, wherein:

when the length of the image is greater than the length of the recording area and the part of the image that will fit in the recording area is recorded, and the next medium stored in the storage unit can be processed, the process control unit reports the same to the control device.

4. The media processing device described in claim 2, wherein:

when the length of the image is greater than the length of the recording area, and the part of the image that will fit in the recording area is recorded, the process control unit discards the portion of the original image data that was not recorded.

5. The media processing device described in claim 1, further comprising:

a detection unit that detects the length of the medium conveyed by the conveyance unit;

wherein the process control unit calculates the length in the conveyance direction of the image to be recorded on the medium based on image data received from the control device, compares the calculated image length and the length of the recording area determined from the length in the conveyance direction of the medium detected by the detection unit, and when the length of the image is greater, records the part of the image that will fit in the recording area with the recording unit.

6. The media processing device described in claim 1, further comprising:

a reading unit that is disposed to the conveyance path and reads the medium conveyed by the conveyance unit;

wherein the process control unit controls the switching unit, conveyance unit, recording unit, and reading unit, and continuously applies to the plural media stored in the storage unit a process including conveyance from the storage unit through the conveyance path to the discharge unit, recording on the medium being conveyed using the recording unit, and reading the medium being conveyed using the reading unit.

7. A method of controlling a media processing device that can connect to a control device and has a storage unit that can hold a plurality of media, a conveyance path that connects to the storage unit and conveys the media, a plurality of discharge units that can connect to the conveyance path and receive media discharged from the conveyance path, a switching unit that changes the discharge unit into which the media are discharged, a conveyance unit that conveys the media from the storage unit through the conveyance path to the discharge unit, and a recording unit that is disposed to the conveyance path and records on the media conveyed by the conveyance unit, wherein the control method comprises steps of:

recording the part of the image that will fit in the recording area with the recording unit, causing the switching unit to change the discharge unit so that media are discharged into different discharge units depending on whether the length of the recording area is shorter or longer than the image length, and conveying the next medium stored in the storage unit with the conveyance unit when the length in the conveyance direction of an image to be recorded on the medium is greater than the length of a recording area determined by the length of the medium in the conveyance direction.

8. The method of controlling a media processing device described in claim 7, further comprising steps of:

detecting the trailing end of the medium with a sensor that is disposed on the upstream side of the recording unit and detects the medium; and recording the portion of the image that will fit in the recording area with the recording unit by prohibiting the recording unit from recording an image on the upstream side of a position corresponding to the trailing end of the medium when the length of the image is greater than the length of the recording area.

9. The method of controlling a media processing device described in claim 8, further comprising a step of:

reporting to the control device when the length of the image is greater than the length of the recording area and the part of the image that will fit in the recording area is recorded, and the next medium stored in the storage unit can be processed.

10. The method of controlling a media processing device described in claim 8, further comprising a step of:

discarding the portion of the original image data that was not recorded when the length of the image is greater than the length of the recording area, and the part of the image that will fit in the recording area is recorded.

11. A recording medium storing a program that is executed by a control unit that controls parts of a media processing device that can connect to a control device and includes a storage unit that can hold a plurality of media, a conveyance path that connects to the storage unit and conveys the media, a plurality of discharge units that can connect to the conveyance path and receive media discharged from the conveyance path, a switching unit that changes the discharge unit into which the media are discharged, a conveyance unit that conveys the media from the storage unit through the conveyance path to the discharge unit, and a recording unit that is disposed to the conveyance path and records on the media conveyed by the conveyance unit, the program causing the control unit to:

control the switching unit, conveyance unit, and recording unit; and when the length in the conveyance direction of an image to be recorded on the medium is greater than the length of a recording area determined by the length of the medium in the conveyance direction, record the part of the image that will fit in the recording area with the recording unit, cause the switching unit to change the discharge unit so that media are discharged into different discharge units depending on whether the length of the recording area is shorter or longer than the image length, and convey the next medium stored in the storage unit with the conveyance unit.

* * * * *